US005360073A

United States Patent [19]

Akazawa

[11] Patent Number: 5,360,073

[45] Date of Patent: Nov. 1, 1994

[54] BATTERY TYPE SCREW DRIVER

[75] Inventor: Shumi Akazawa, Fuchu, Japan

[73] Assignee: Ryobi Limited, Tokyo, Japan

[21] Appl. No.: 28,991

[22] Filed: Mar. 10, 1993

[30] Foreign Application Priority Data

Mar. 12, 1992 [JP] Japan ..... 4-53207

[51] Int. Cl.[5] ..... B25B 23/00

[52] U.S. Cl. ..... 173/15; 173/217; 81/475

[58] Field of Search ..... 173/13, 15, 216, 217; 81/474, 475, 476

[56] References Cited

U.S. PATENT DOCUMENTS 2,569,244 9/1951 Larson ..... 173/15
2,570,164 10/1951 Shaff ..... 173/15
3,613,751 10/1971 Juhasz ..... 81/474
4,458,565 7/1984 Zilly et al. ..... 81/475
5,094,133 3/1992 Schreiber ..... 173/15

*Primary Examiner*—Richard K. Seidel
*Assistant Examiner*—Hwei-Siu Payer
*Attorney, Agent, or Firm*—Brooks & Kushman

[57] ABSTRACT

A battery type screw driver has an auxiliary switch 39 in addition to a main switch 37. A clutch 30 is provided between a driving shaft 16 and a driven shaft 11. A central bore 32 is formed along the central axis of the driving shaft 16. The operation bar 33 passes through the bore 32. A front end part of the operation bar 33 is connected to the driven shaft 11, while a rear end part thereof protrudes backwardly of the driving shaft 16. An auxiliary switch 39 is disposed in series with the main switch 37 in an electric circuit between the motor 8 and a battery 35. The auxiliary switch 39 is turned on when depressed by the operation bar 33 sliding backward when the screw 24 is fastened. The operation bar slides coaxially with the central axis of the driving shaft.

10 Claims, 12 Drawing Sheets

BATTERY TYPE SCREW DRIVER

BACKGROUND OF THE INVENTION

Field of the Invention

The present invention relates to a battery type screw driver.

Related Background Art

A conventional AC/battery screw driver is provided with only a main switch without an auxiliary switch. Hence, a motor is actuated during operations other than an actual fastening process, which include an operation for confirming a screw fitting location and an operation for fitting of the screw to a bit. Consequently, there arise the following problems. (1) A loss in energy is caused especially when the battery serves as a motive power supply, resulting in a reduction inwork done per charging. (2) The motor and gear sounds are continuously generated during the operation to cause noises.

Japanese Patent Laid-Open Publication No. 61-76281 discloses a screw driver which can obviate the defects described above.

In the screw driver, the motor is rotated when the screw driver is pushed against a screw in a state of depressing the main switch. For this purpose, as illustrated in FIG. 17, the screw driver includes a microswitch as an auxiliary switch 1. This auxiliary switch 1 is disposed in series with the main switch in a driving circuit of the motor. The auxiliary switch 1 does not function simply by applying the bit 2 to the screw 3 (FIG. 17A). When the bit 2 is pushed against the screw 3, a driving shaft 4, front cover 5*a*, and a load detection unit 5 are all together moved backwards by the reaction thereof. The auxiliary switch is thereby turned on (FIG. 17B). Then, the motor is actuated for the first time, thus rotating the bit 2 through the driving shaft 4.

The conventional screw driver described above is, however, provided with the ring-like load detection unit 5. The load detection unit 5 slides in accordance with a sliding motion of the driving shaft 4. The auxiliary switch 1 is depressed by a projection 6 formed on the unit 5. The projection 6 exists in a position deviated largely from the driving shaft 4. There is a possibility that the operation of the auxiliary switch 1 is inaccurate. Further, the auxiliary switch 1 has to be provided in a gear box G behind the driving shaft 4. It is troublesome to install the auxiliary switch 1, and the auxiliary switch 1 is apt to be out of order. Besides, if grease in the gear box permeates the auxiliary switch 1, electrical trouble could result.

SUMMARY OF THE INVENTION

To obviate the problems described above, according to the present invention, there is provided a battery type screw driver comprising a driving shaft rotated by a motor disposed in a housing of said battery type screw driver, a driven shaft disposed to axially slide with respect to said driving shaft so as to move away from and close to said driving shafts said driven shaft holding a bit at its front end, a clutch interposed between said driving shaft and said driven shaft, an operation bar disposed slidably on the central axis of said driving shaft a front end part of said operation bar being engaged with said driven shaft and an auxiliary switch disposed so as to be connect directly or indirectly to a rear end part of said operational bar to be turned on and off in accordance with an axial movement of said operation bar.

Further, there may be adopted such a construction that the operation bar turns on the auxiliary switch before the clutch is brought into a motive power transmitting state.

When the screw is fastened, the main switch is turned on. Next, the bit is pushed against the screw, and the driven shaft is then slid backwards by the reaction thereof along the central axis of the driving shaft to connect the clutch.

Further, with the backward movement of the driven shaft, the operation bar slides backwards within the driving shaft to turn on the auxiliary switch. The operation bar is disposed coaxially with the driving driven shafts. The auxiliary switch is therefore accurately manipulated.

When the auxiliary switch is turned on, an electric circuit between the motor and the battery is closed. The motor starts to rotate the driving shaft. The driven shaft is also rotated through the clutch to rotate the bit. With the rotations of the bit, the screw is fastened.

Upon the completion of fastening of a single screw, the bit is released from the screw. Then, the clutch is disconnected by a repulsive force provided between the driving and driven shafts, and the operation bar is separated from the auxiliary switch. The motor is thereby stopped. The driven shaft and the bit immediately stop their rotations.

In the case of repeatedly fastening the screw, the screw can be rotated only by pushing the bit against the screw with a depression of the main switch. Namely, every time the bit is pushed against the screw, the motor is actuated, and the bit can be rotated.

Furthermore, the auxiliary switch can be turned on before the clutch is connected. For this reason, a first clutch disc on the driving shaft is engaged with a second clutch disc on the driven shaft while the first clutch disc is rotated. The clutch is thereby smoothly connected.

In the accompanying drawings:

Other objects and advantages of the present invention will become apparent during the following discussion taken in conjunction with the accompanying drawings.

DESCRIPTION OF THE PREFERRED EMBODIMENTS

An embodiment of a battery type screw driver according to the present invention will now be described.

Figure 1:
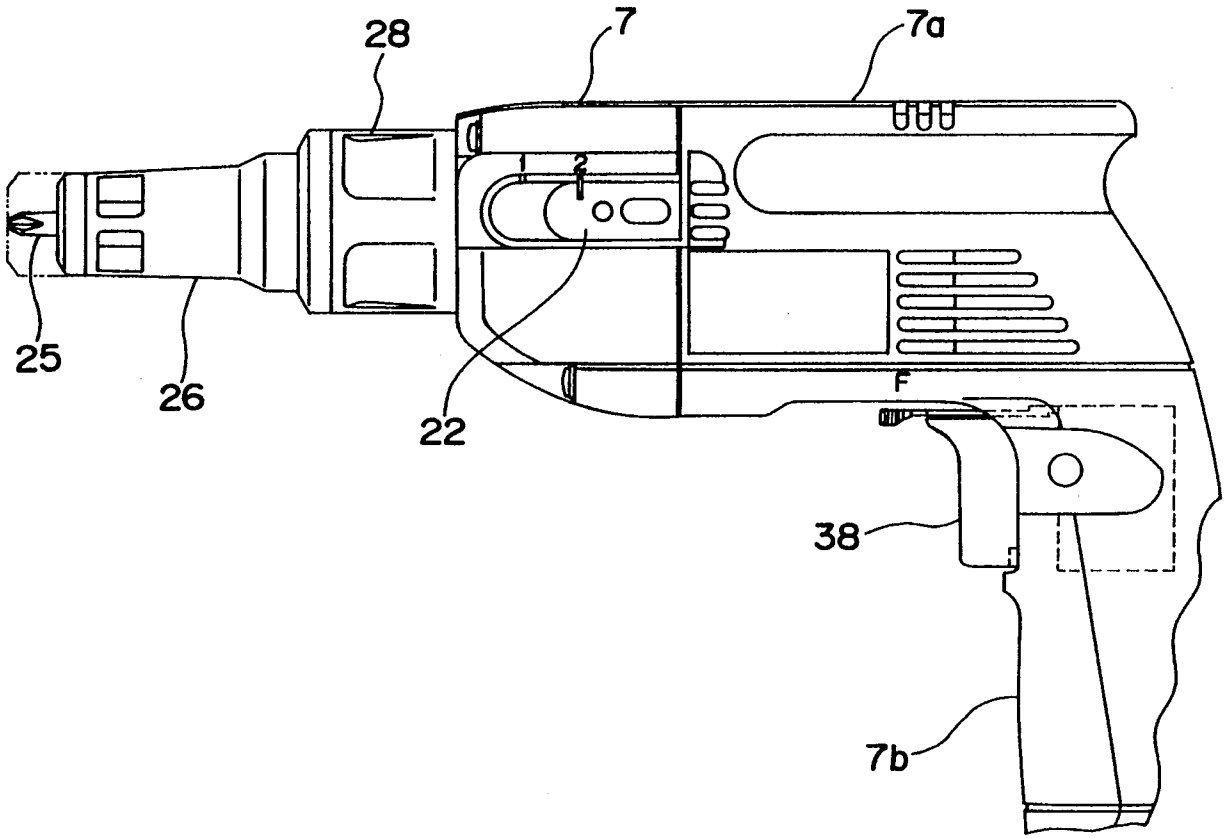
FIG. 1 is a partially cutaway side view of a battery type screw driver according to the present invention.
Figure 2:
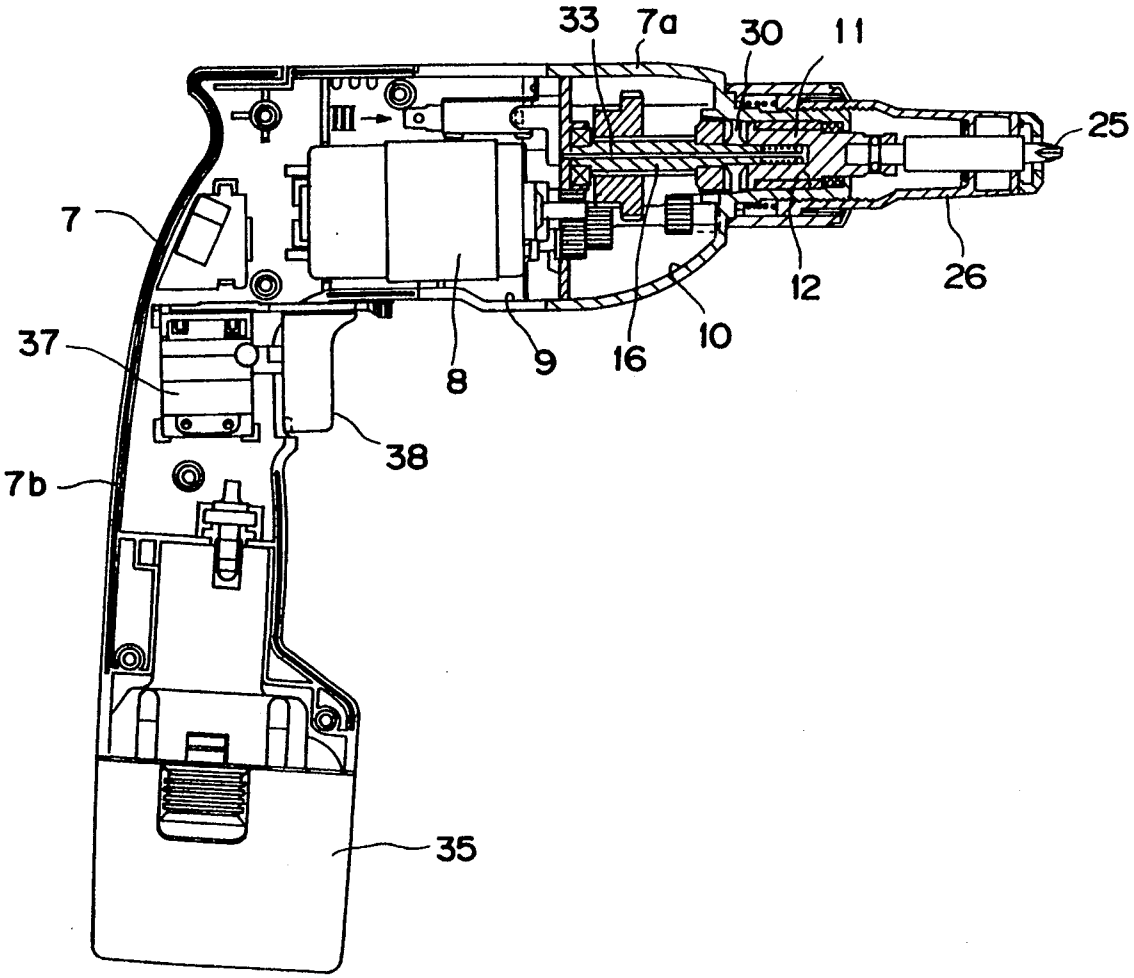
FIG. 2 is a vertical sectional view of the battery type screw driver.

As illustrated in FIGS. 1 and 2, a housing 7 of this battery type screw driver is constructed of an upper section 7*a* for housing a power unit and a lower section 7*b* serving as a handle.

The upper section 7*a* of the housing includes, in the order from the rear part of the upper section 7*a* to the front part thereof, a housing chamber 9 for a motor 8 serving as a power supply, a gear chamber 10 for a gear mechanism and a housing chamber 12 for a driven shaft 11.

Figure 4:
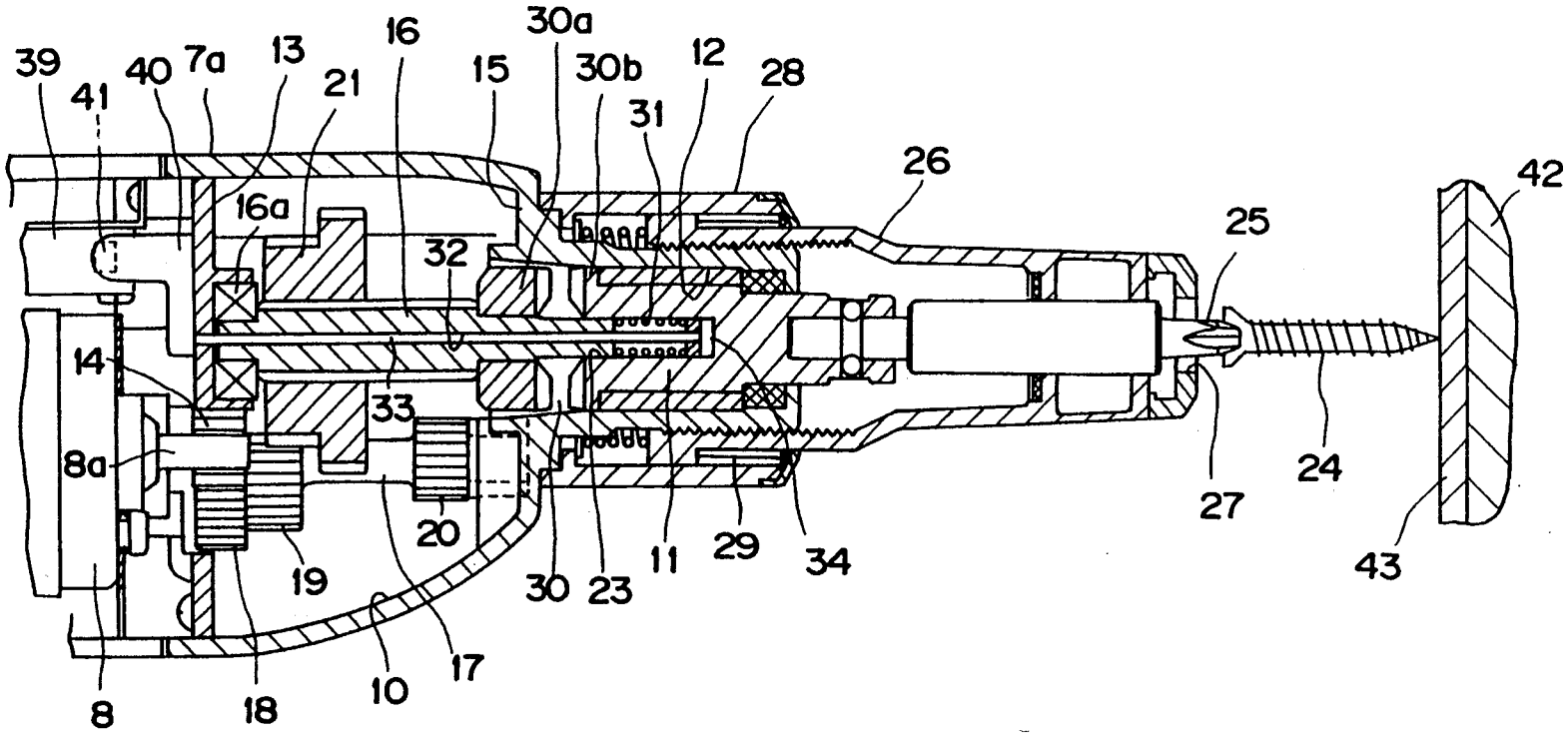
FIG. 4 is a vertical sectional view of a driving unit of the battery type screw driver Just before fastening a screw.
Figure 5:
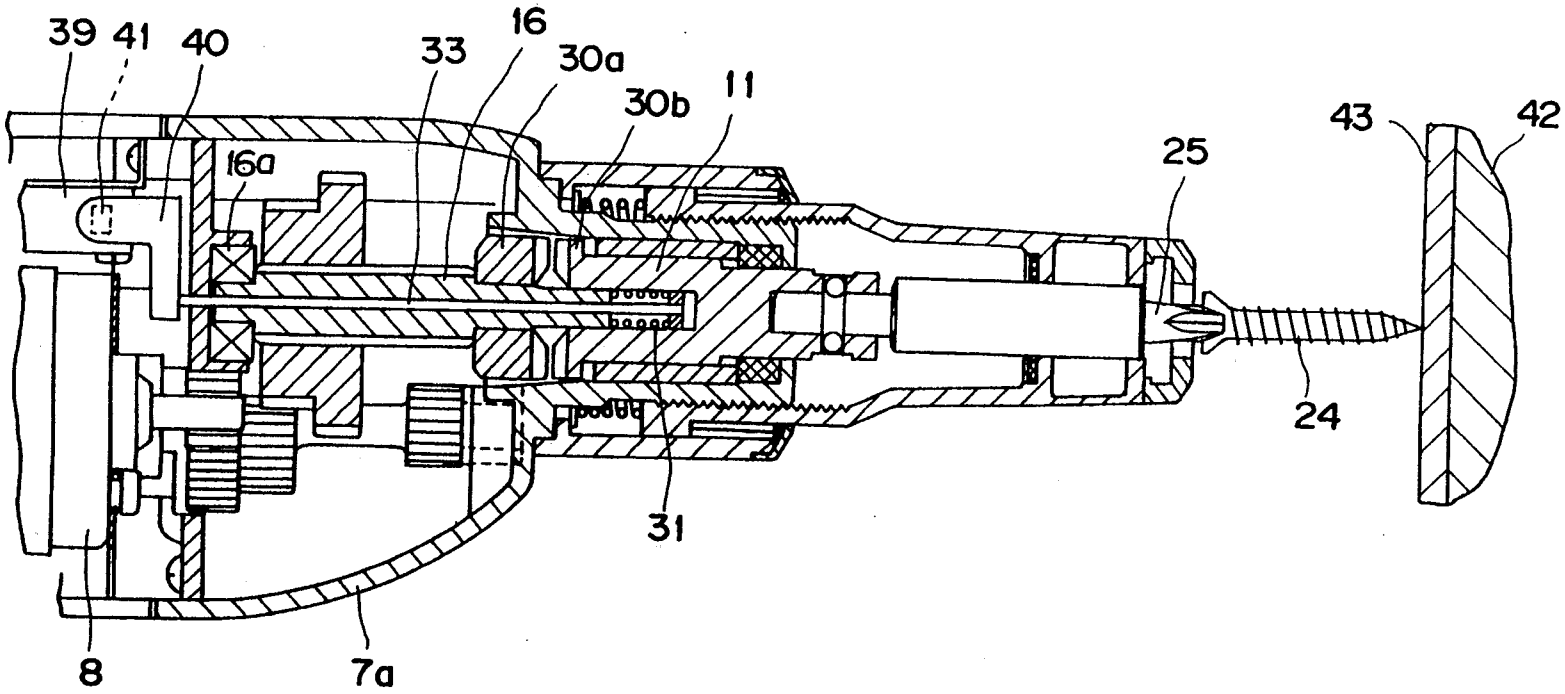
FIG. 5 is a vertical sectional view of the driving unit of the battery type screw driver Just when pushing the bit against the screw in the fastening direction.

The motor 8 is laterally accommodated in the housing chamber 9. As shown in FIG. 4, an output shaft 8*a* of the motor 8 penetrates a rear partition wall 13 into the gear chamber 10. A gear 14 is fixed to the output shaft 8*a*.

In the gear chamber 10, as illustrated in FIG. 4, a driving shaft 16 extends laterally. A rear part of the driving shaft 16 is axially supported on the rear partition wall 13. The front part thereof penetrates a front partition wall 15 into the housing chamber 12 for the driven shaft 11. Further, an intermediate shaft 17 for transmitting the power of the motor 8 to the driving shaft 16 is axially supported between the two partition walls 13, 15.

To the intermediate shaft 17 are fixed first and second intermediate gears 19, 20 each having a different number of teeth in addition to a gear 18 meshing with the gear 14 of the output shaft 8*a* of the motor 8.

The driving shaft 16 forms a spline shaft within the gear chamber 10. On the spline shaft is mounted slidably a final gear 21 selectively engaging with any of the first and second intermediate gears 19, 20.

The final gear 21 is held by a fork (not shown) of a lever 22 protruding outwardly of the housing 7 shown in FIG. 1. The final gear 21 meshes with either the first or second intermediate gears 19, 20 while sliding on the driving shaft 16 by switching the lever 22.

In a state of FIG. 4, however, when the motor 8 is driven, the power of the motor 8 is transmitted to the driving shaft 16 via a gear train consisting of a variety of gears 18, 19, 20, 21 thereby to rotate the driving shaft 16 at a predetermined speed ratio in the gear chamber 10.

The tip of the driving shaft 16 penetrates the front partition wall 15 to enter the housing chamber 12 for the driven shaft 11. The driven shaft 11 is so disposed inwardly of the housing chamber 12 as to be slidable along the line of extension of the central axis of the driving shaft 16. A hole 23 is formed along the central axis of the rear part thereof. The tip of the driving shaft 16 is slidably accommodated in the hole 23. Further, a bit 25 for rotating a screw 24 is detachably attached to the front part of the driven shaft 11.

A portion, corresponding to the driven shaft housing chamber 12, of the housing 7 assumes a cylindrical shape. This portion is formed with a male screw. An adjust sleeve 26 is engaged with the male screw. The front part of the adjust sleeve 26 is formed with a hole 27. The tip of the bit 25 goes in and out of this hole 27. An amount of protrusion of the bit 25 can be regulated by rotating the adjust sleeve 26.

Besides, the adjust sleeve 26 is covered with an operation cylinder 28. The adjust sleeve 26 is slidably engaged with an elongate projection 29 which is so formed on the inner surface of the operation cylinder 28 as to extend in the longitudinal direction. That is, the sleeve 26 is rotated together with the operation cylinder 28, and slidably moved in the axial direction of the operation cylinder 28. When the operation cylinder 28 is rotated in any direction, the adjust sleeve 26 moves back and forth while being rotated. The amount of protrusion of the bit 25 is thereby regulated.

A clutch 30 is provided between the driving shaft 16 and the driven shaft 11 in the boundary area between the gear chamber 10 and the driven shaft housing chamber 12.

In this case, the clutch 30 is of a gear type and has a clutch disc 30*a* on the driving side thereof. The clutch disc 30*a* is fitted to a middle part of the driving shaft 16. A clutch disc 30*b* on the driven side thereof is so provided integrally with the shaft 11 at the rear end of the driven shaft 11.

Further, a compression coil spring 31 as an elastic member is accommodated in the hole 23 of the driven shaft 11. The compression coil spring 31 acts to separate the driven shaft 11 from the driving shaft 16 to thereby urge the driven shaft 11 toward the front of the housing 7. Therefore, the clutch 30 is normally disconnected so as to be in the power cut-off condition. When a force is exerted from the bit 25, the driven shaft 11 slides backwards while compressing the elastic member 31. The driven shaft 11 is then connected to the driving shaft 16 through the clutch 30.

The driving shaft 16 is formed with a central bore 32 along the central axis thereof. Then, an operation bar 33 slidably passes through the central bore 32. The operation bar 33 projects into the hole 23 of the driven shaft 11 to have a plate 34 as an engaging member for engaging the operation bar with the driven shaft 11 at its front end. The plate 34 is pushed by the elastic member 31 toward the bottom of the hole 23. Further, the rear end of the operation bar 33 protrudes backwardly of the driving shaft 16 and slidably penetrates the rear partition wall 13 into the interior of the motor housing chamber 9.

With this arrangement, when a force is applied from the bit 25 to the driven shaft 11, the driven shaft 11 slides backwards. At this time, two discs 30*a*, 30*b* of the clutch 30 are engaged with each other, and the operation bar 33 is moved backwards.

The driving shaft 16 is rotatably supported on the rear partition wall 13 via a bearing 16*a*. The rear end of the operation bar 33 passes through the rear partition wall 13 to contact a switch lever 40 (FIGS. 9 to 11) of the auxiliary switch 39. The operation bar 33 is located on the center axis of the driving and driven shafts 16, 11. Further, the clutch 30 is disposed coaxially with the driving and driven shafts 16, 11.

According to this structure, the operation bar 33 is pushed straightly along the center axis of the driving and driven shafts 16, 11 by a repulsive force exerted on the bit 25 when the screw 24 is pressed. Therefore, no bending force is exerted on the operation bar 33 to cause the operation bar 33 to operate the auxiliary switch 39 smoothly.

The operation bar 33 turns on the auxiliary switch 39 before the clutch 30 is connected to be in a power transmission condition. That is, a switch button 41 of the auxiliary switch 39 is operated before the two discs 30*a*, 30*b* are engaged with each other. In this manner, if the switch lever 40 is operated to drive the motor 8 before the clutch 30 is in a power transmission condition, the clutch discs 30*a*, 30*b* can be smoothly engaged with each other. In more detail, when the screw driver is pushed in the direction where the screw is fastened, the driven shaft 11 is moved backward to start engaging the two discs 30*a*, 30*b* of the clutch 30 with each other. At this time since the driving shaft 16 is rotated, the clutch discs 30*a*, 30*b* can be meshed smoothly with each other.

Figure 14:
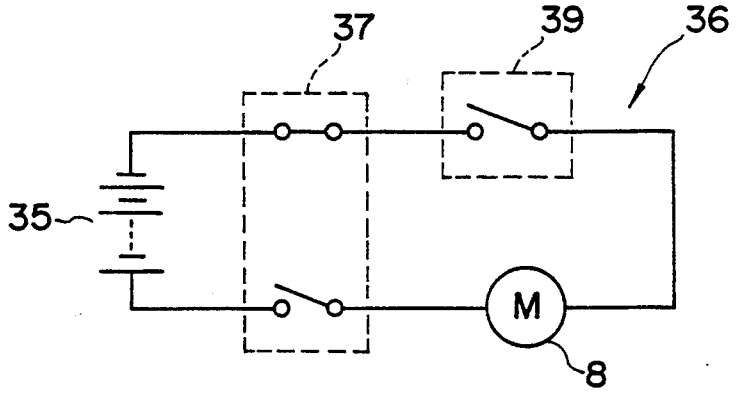
FIG. 14 is a diagram illustrating an electric circuit between a battery and a motor in a state where contact points of the main and auxiliary switches are opened.

As shown in FIG. 2, a battery 35 for driving the motor 8 is detachably attached to the lower section 7*b*, serving as the handle, of the housing 7. The motor 8 and the battery 35 are electrically connected with each other via an electric circuit 36 as shown in FIG. 14. The electric circuit 36 incorporates a main switch 37. As illustrated in FIGS. 1 and 2, an operation lever 38 for the main switch 37 protrudes outwardly of the boundary area between the upper and lower sections 7*a*, 7*b* of the housing 7.

Besides, the electric circuit 36 includes an auxiliary switch 39 disposed in series with the main switch 37. The circuit 36 is turned on when the switch lever 40 is depressed by the operation bar 33.

Figure 3:
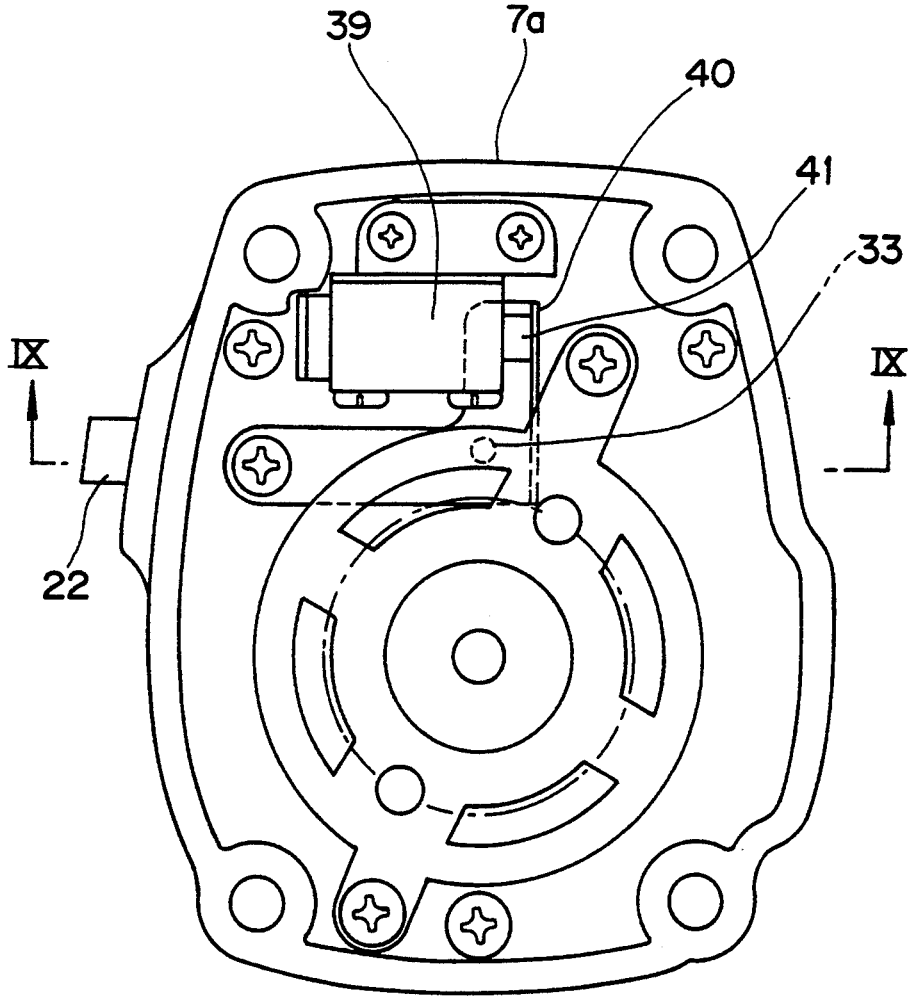
FIG. 3 is a view taken in the direction III in FIG.2.
Figure 9:
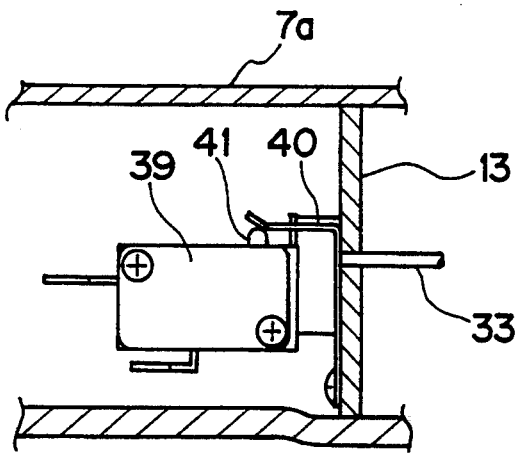
FIG. 9 is a sectional view taken along the line IX—IX in FIG. 3, showing a positional relationship between an auxiliary switch and an operation bar for an OFF-time.

The auxiliary switch 39 is a microswitch in this case, and, as illustrated in FIGS. 3, 4 and 9, fixed in a predetermined location within the motor housing chamber 9. Further, the switch lever 40 of L-shape is mounted on the rear partition wall 13 so that the lever 40 is moved away from and close to the partition wall 13. A portion of the switch lever 40 faces to the rear end of the operation bar 33, while the other portion faces to the switch button 41 of the auxiliary switch 39. The switch lever 40 is composed of a spring member, and separated from the rear partition wall 13 when depressed by the operation bar 33 to push the switch button 41 of the auxiliary switch 39. When the switch lever 40 is released from the operation bar 33, the switch lever 40 returns to an original position to separate from the switch button 41.

The switch lever 40 may be omitted, and the operation bar 33 may be also brought into direct contact with the switch button 41.

Figure 15:
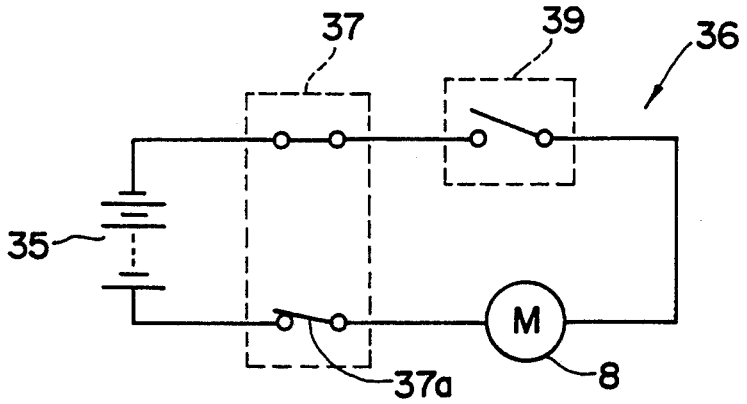
FIG. 15 is a diagram illustrating the electric circuit between the battery and the motor in a state where the contact point of the main switch is closed.
Figure 16:
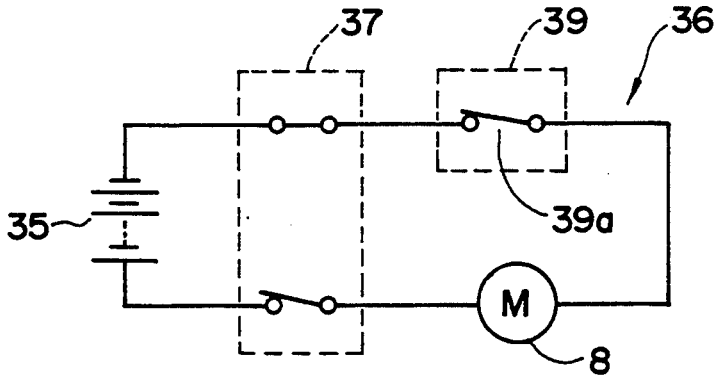
FIG. 16 is a diagram illustrating the electric circuit between the battery and the motor in a state where the contact points of the main and auxiliary switches are closed.
Figure 17A:
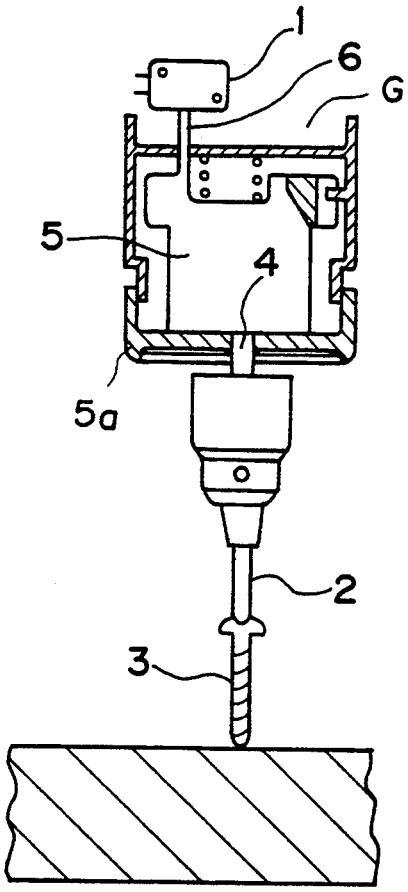
FIG. 17A PRIOR ART
FIG. 17(A) is a partially cutaway view of the principal portion of a conventional battery type screw driver, illustrating a state just before fastening the screw.
Figure 17B:
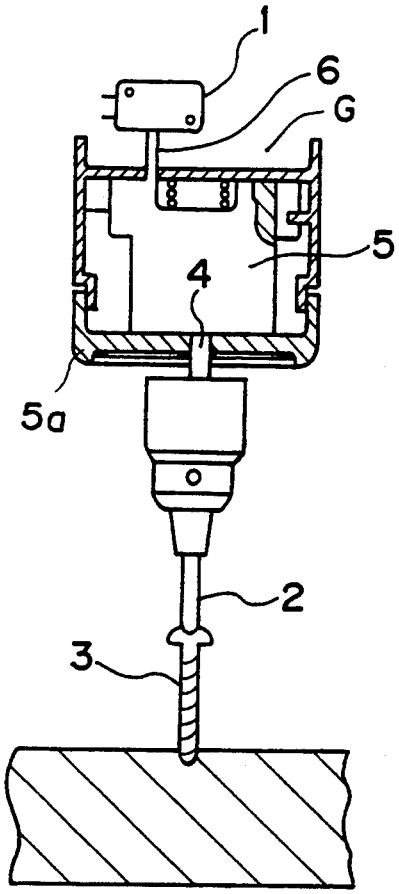
FIG. 17B PRIOR ART
FIG. 17(B) is a partially cutaway view of the principal portion of the conventional battery screw driver, showing a state where a fastening of the screw is started.

When the main switch 37 is depressed, a contact point 37*a* thereof is closed as shown in FIG. 15. Subsequently, when the bit 25 is set on the screw 24 and pushed against the screw 24, the driven shaft 11 is moved back by the reaction thereof to be connected to the driving shaft 16 through the clutch 30. At the same time, the operation bar 33 is moved back together with the driven shaft 11 to push the switch button 41 of the auxiliary switch 39. A contact point 39*a* is closed as illustrated in FIG. 16. The electric circuit 36 is thereby energized, and the motor 8 is started.

Next, the operation of the battery type screw driver will be explained.

When the screw is fastened, a contact point 37*a* of the main switch 37 is first turned on by pushing the operation lever 38 for the main switch 37 (FIG. 15). At this time, the bit 25 does not hold the screw 24, and the operation bar 33 is located in the position shown in FIG. 9. The motor 8 is therefore not driven.

Next, a mounting member 43 is applied to a base member 42, and the screw 24 is set to the bit 25. The screw 24 is applied to a fastening location (FIG. 4).

Figure 10:
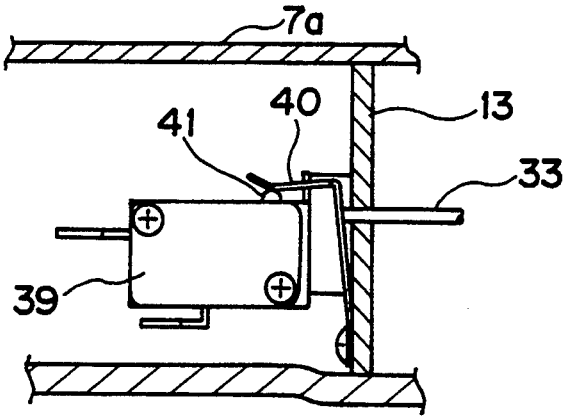
FIG. 10 is a sectional view similar to FIG. 9, showing a state where the operation bar starts protruding towards the auxiliary switch from the position illustrated in FIG. 9.

Subsequently, when the battery type screw driver is pushed against the screw fastening location, the driven shaft 11 slides backwards together with the bit 25 within the housing, compressing the elastic member 31. The operation bar 33 slides backwards in the central bore 32 of the driving shaft 16 to push backwards the switch lever 40 (FIG. 10). The auxiliary switch 39 is thereby turned on to energize the electric circuit 36 (FIG. 16), resulting in that the motor 8 is started. However, since the clutch 30 has not yet connected the driven shaft 11 remains stopped irrespective of rotation of the driving shaft 16.

Figure 6:
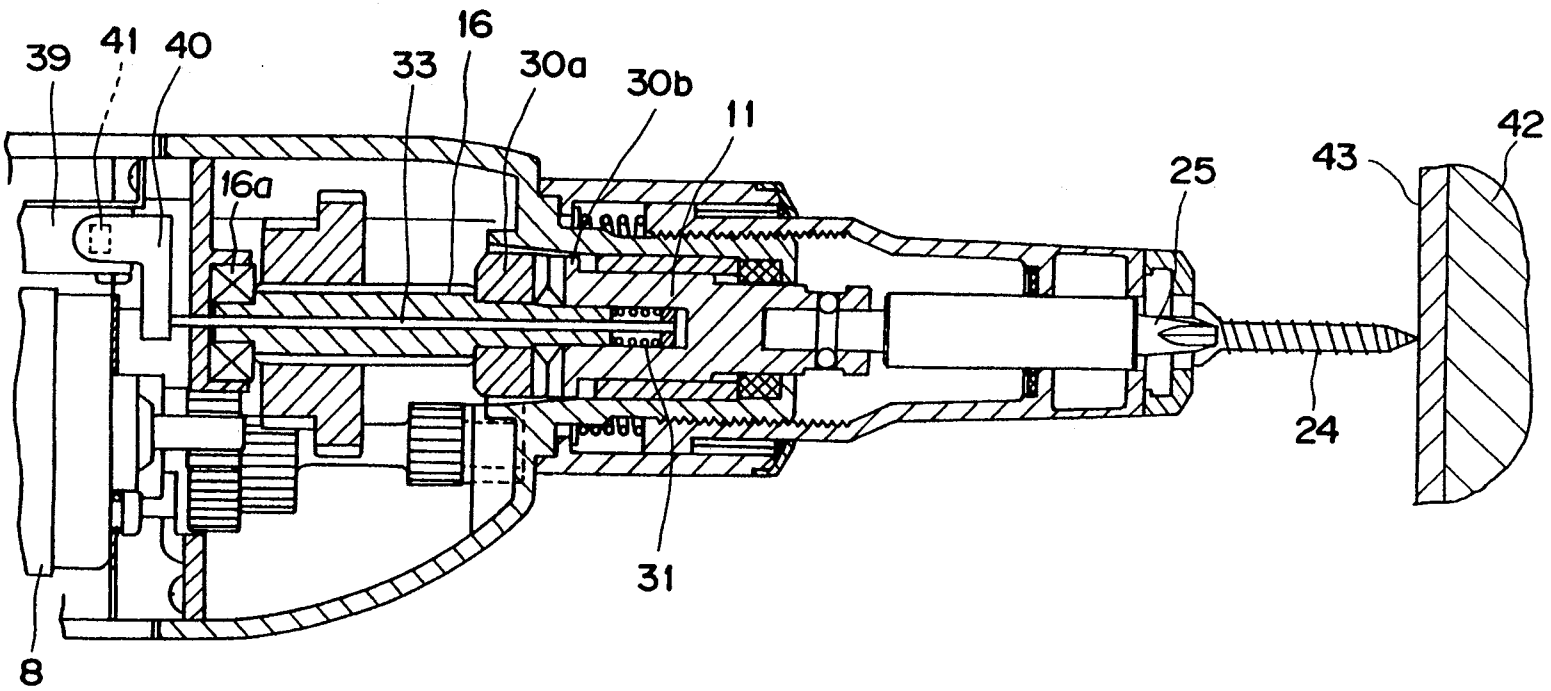
FIG. 6 is a vertical sectional view of the driving unit of the battery type screw driver Just when further pushing the bit against the screw in the fastening direction from the state shown in FIG. 5.

When the battery type screw driver is further pushed towards the screw fastening location, the driven shaft 11 is further moved backwards. At this time, the clutch 30 begins to be connected (FIG. 6) while the driving shaft 16 is rotated. Therefore, the clutch discs 30*a*, 30*b* smoothly engage with each other.

Figure 11:
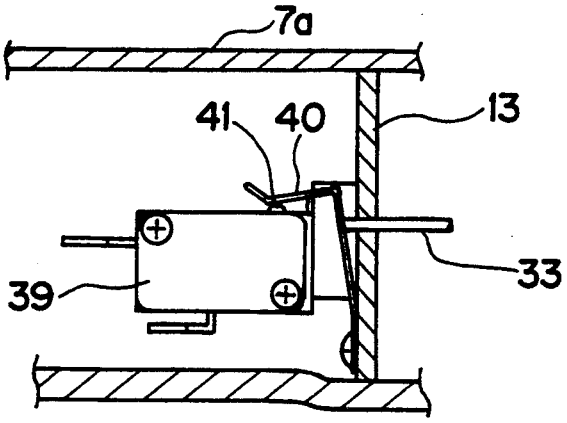
FIG. 11 is a sectional view similar to FIG. 9, showing a state where the operation bar further protrudes towards the auxiliary switch from the position illustrated in FIG. 10.

The operation bar 33 also moves further backwards to continuously push the auxiliary switch 39 (FIG. 11).

Figure 7:
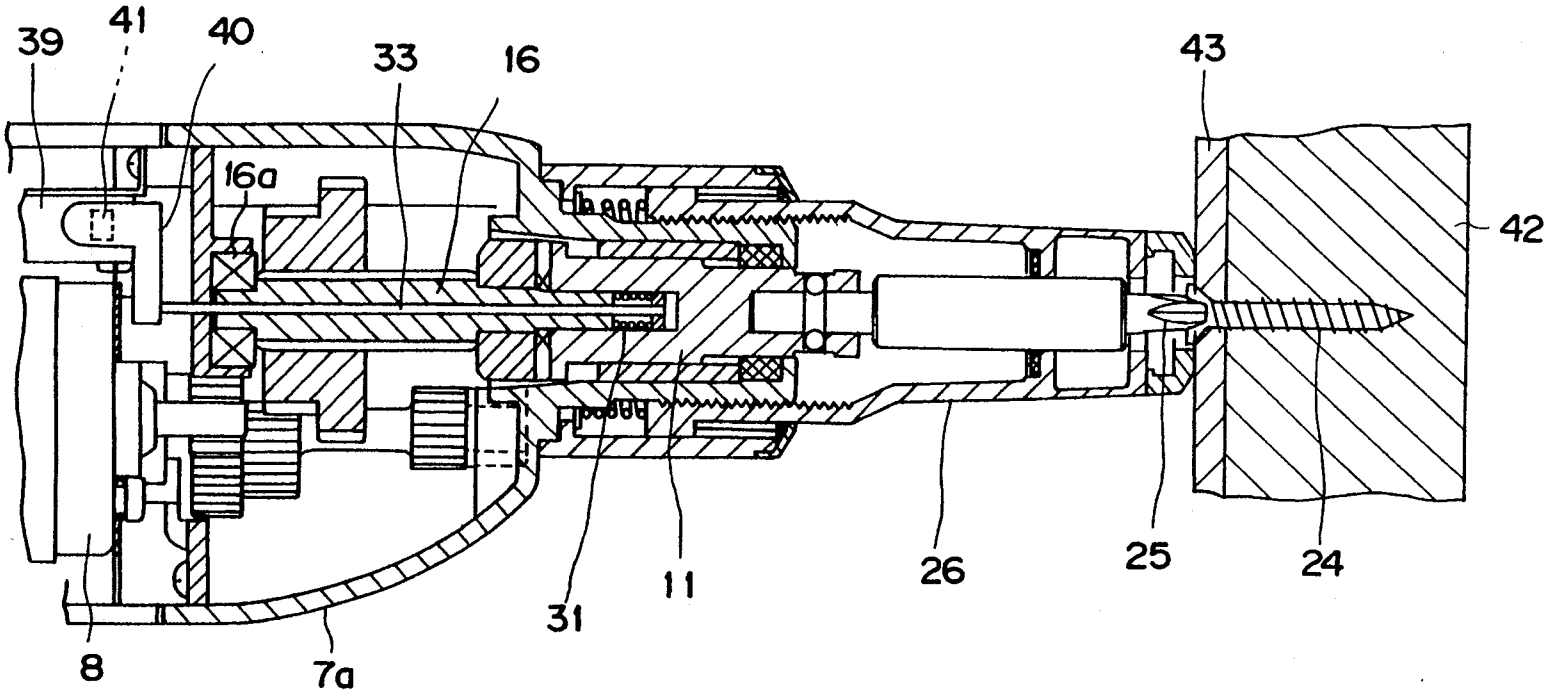
FIG. 7 is a vertical sectional view of the driving unit of the battery type screw driver Just before finishing the fastening of the screw.
Figure 12:
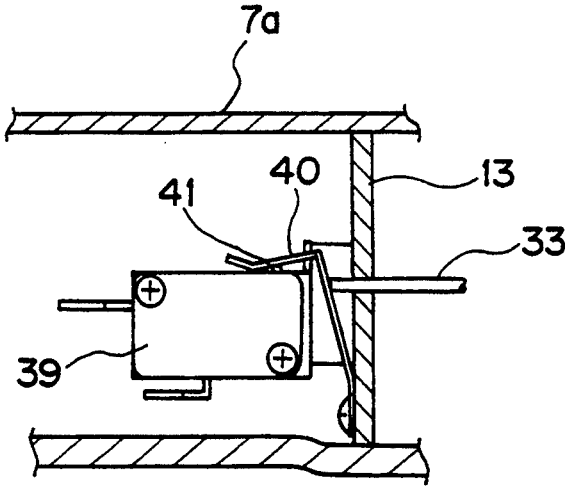
FIG. 12 is a sectional view similar to FIG. 9, illustrating a state where the operation bar still further protrudes towards the auxiliary switch from the position shown in FIG. 11.

With a complete connection of the clutch 30, the fastening of the screw 24 smoothly progresses (FIGS. 7 and 12).

Figure 8:
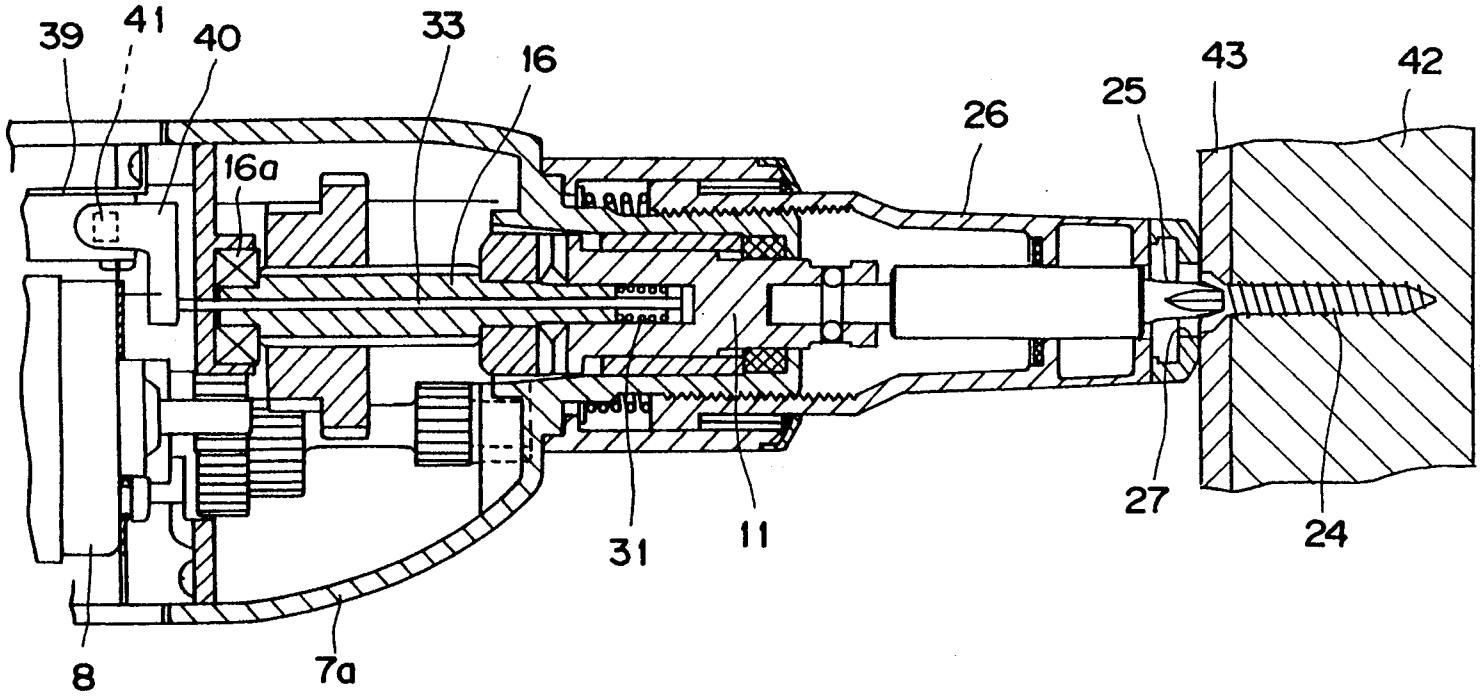
FIG. 8 is a vertical sectional view of the driving unit of the battery type screw driver immediately after fastening the screw.
Figure 13:
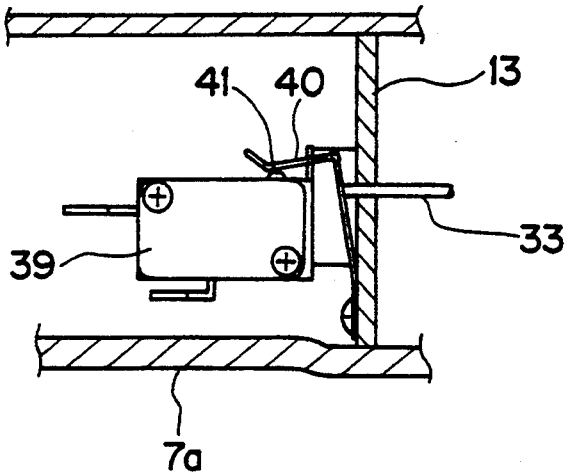
FIG. 13 is a sectional view similar to FIG. 9, illustrating a state where the operation bar is going back to the position opposite to the auxiliary switch.

Just when the front end of the adjust sleeve 26 impinges on the surface of the mounting member 43, the bit 25 protrudes forward from the hole 27 of the adjust sleeve 26. The clutch 30 is thus disconnected. The driven shaft 11 stops rotating, and the fastening of the screw is completed. At this time, a head of the screw 24 is flush with the surface of the mounting member 43 (FIG. 8). At this time, the operation bar 33 still pushes the auxiliary switch 39 (FIG. 13), and rotation of the motor 8 is maintained.

When, the battery type screw driver is separated from the screw fastening location, the operation bar 33 releases the switch lever 40, whereby the auxiliary switch 39 is turned off. The motor 8 then stops (FIGS. 4, 9 and 15).

Subsequently, when the screw is fastened, the operations described above may be repeated while the operation lever 38 of the main switch 37 is pushed. More specifically, the auxiliary switch 39 is closed only by pushing the bit 25 against the screw 24. Thereafter, the motor 8 is immediately actuated. The clutch 30 is connected, and the bit 25 starts rotating.

According to the invention, the motor rotates only when actually fastening the screw. An operating time of the battery is therefore reduced. A loss in energy of the battery power supply is decreased. Further, the motor does not rotate except when the screw is actually fastened to reduce noises. Besides, the operation bar 33 is coaxial with the driven shaft 16. The operation of the auxiliary switch 39 is therefore accurate. Moreover, the operation bar 33 is disposed within the driving shaft 16, and the auxiliary switch 39 is provided outwardly of a gear box for housing the driving shaft 16 to prevent a breakdown of the auxiliary switch 39. Therefore, the driving shaft 16 rotates and stops exactly, thereby smoothing the fastening of the screw. Further, when the bit 25 is released from the screw upon completion of the fastening of the screw 24, the clutch is disconnected, and immediately the driven shaft 11 stops. Consequently, the auxiliary switch 39 is accurately operated, and the screw fastening is performed smoothly.

Additionally, according to the invention, the driven shaft 11 can be connected to the driving shaft 16 being rotating to connect the clutch 30. The clutch 30 is thus smoothly connected, and an efficiency for fastening the screw can be increased.

Although the illustrative embodiment of the present invention has been described in detail with reference to the accompanying drawings, it is to be understood that the present invention is not limited to that embodiment. Various changes or modifications may be effected by one skilled in the art without departing from the scope or spirit of the invention.

What is claimed is:

1. A battery type screw driver comprising:

a driving shaft rotated by a motor disposed in a housing of said battery type screw driver;

a driven shaft disposed to axially slide with respect to said driving shaft so as to move away from and close to said driving shaft, said driven shaft holding a bit at its front end;

a clutch interposed between said driving shaft and said driven shaft;

an operation bar disposed slidably on the central axis of said driving shaft, a front end part of said operation bar being engaged with said driven shaft; and an auxiliary switch connected directly or indirectly to a rear end part of said operation bar to be turned on and off in accordance with an axial movement of said operation bar.

2. A battery type screw driver according to claim 1, wherein said operation bar is constructed to turn on said auxiliary switch before said clutch takes a motive power transmitting state.

3. A battery type screw driver according to claim 1, wherein an elastic member is disposed between said driving and driven shafts so as to separate said two shafts from each other.

4. A battery type screw driver according to claim 1, wherein said driving shaft is rotatably supported on a partition wall disposed in the housing via a bearing.

5. A battery type screw driver according to claim 4, wherein a rear end of said operation bar is passed through said partition wall to turn on and off said auxiliary switch disposed on the opposite side to said driving shaft with respect to said partition wall.

6. A battery type screw driver according to claim 5, wherein said operation bar turns on and off said auxiliary switch via a switch lever.

7. A battery type screw driver according to claim 1, wherein a front portion of said driving shaft is slidably inserted into a hole formed in said driven shaft, the front end part of said operation bar being projected into said hole from the front portion of said driving shaft to have an engaging member for engaging said operation bar with said driven shaft, a spring member being provided between the front portion of said driving shaft and the engaging member.

8. A battery type screw driver according to claim 1, wherein said clutch comprises a first clutch disc provided on said driving shaft and a second clutch disc provided on said driven shaft, said two clutch discs being engaged or disengaged with each other in accordance with an axial movement of said driven shaft.

9. A battery type screw driver according to claim 8, wherein said two clutch discs are disposed coaxially with said driving and driven shafts.

10. A battery type screw driver according to claim 1, wherein said auxiliary switch is disposed in series with a main switch in an electric circuit between said motor and a battery.

* * * * *